United States Patent [19]

Lukasczyk

[11] Patent Number: 4,458,289

[45] Date of Patent: Jul. 3, 1984

[54] SOLENOID DRIVE FOR VALVES

[75] Inventor: Wolfgang Lukasczyk, Lohr, Fed. Rep. of Germany

[73] Assignee: Mannesmann Rexroth GmbH, Fed. Rep. of Germany

[21] Appl. No.: 443,624

[22] Filed: Nov. 22, 1982

[30] Foreign Application Priority Data

Dec. 1, 1981 [DE] Fed. Rep. of Germany ..... 3147559

[51] Int. Cl.[3] ..... H01H 47/00

[52] U.S. Cl. ..... 361/139; 251/129; 335/258; 361/152; 361/160

[58] Field of Search ..... 361/139, 143, 146, 152, 361/160, 206, 210; 251/129, 137; 318/98, 99, 100, 133, 135, 432, 514, 515, 555; 335/238, 258; 323/223, 233, 293, 297, 298

[56] References Cited

U.S. PATENT DOCUMENTS

| | | | |
|---|---|---|---|
| 1,803,676 | 5/1931 | Powell | 318/100 |
| 2,721,297 | 10/1955 | Estelle | 361/210 X |
| 3,047,777 | 7/1962 | Becker | 361/210 |
| 3,250,293 | 5/1966 | Adams et al. | 251/129 X |

FOREIGN PATENT DOCUMENTS

| | | | |
|---|---|---|---|
| 842572 | 7/1949 | Fed. Rep. of Germany | 251/129 |
| 1563837 | 4/1970 | Fed. Rep. of Germany | 361/139 |
| 1089596 | 11/1967 | United Kingdom | 251/129 |

*Primary Examiner*—Harry E. Moose, Jr.

*Attorney, Agent, or Firm*—Harness, Dickey & Pierce

[57] ABSTRACT

An adjustable resistance circuitry is connected in parallel to the coil of a solenoid to adjust the actuating force of a magnetic drive means for valves.

7 Claims, 4 Drawing Figures

SOLENOID DRIVE FOR VALVES

Figure 1:
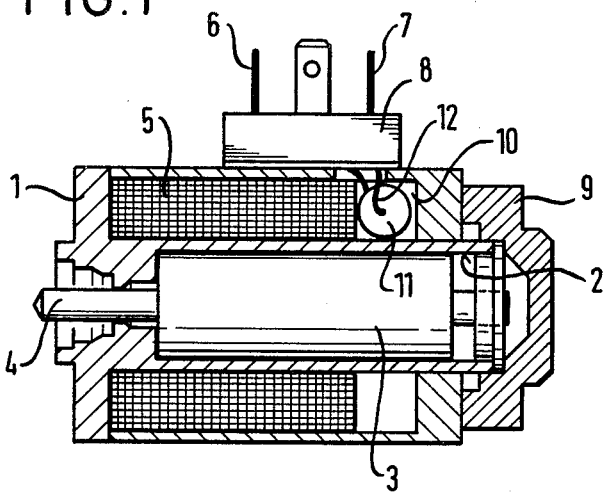

The present invention relates to a solenoid to drive valves in which the actuating force of the armature is proportional to the electrical input signal which is fed to the coil and which actuating force is finely adjustable by means of an alignment circuit.

Proportionally acting solenoids of this type are particularly used to actuate pressure valves and directional control valves, wherein electrical input signals of a predetermined level shall result in corresponding hydraulical output values.

Although the proportional solenoids are manufactured in observing very limited tolerances allowed for and are assembled very accurately they show deficiencies as the solenoid plunger tends to exert different forces even under identical electrical conditions. With proportional pressure valves, for example, those differing forces result in different pressures at the outlet port. With proportional directional control valves, the differing forces result in different strokes and thus in different flow volumes. This is particularly detrimental when proportional valves have to be replaced in a system since any variations of the predetermined valve characteristics are to be avoided.

This is the reason that the valves are adjusted in being manufactured or assembled so that equal electrical input signals result in equal hydraulical output values. According to prior art this balance or alignment is obtained by an adjusting spring which is either a tension spring or a pressure spring and which is placed between the armature of the solenoid and the casing.

By varying the spring bias by means of a screw or nut the force exerted by the spring to the armature is increased or decreased until the desired hydraulical output value (acting force $F_S$) is present when a predetermined electrical input signal (current J) is fed to the coil. This alignment procedure results in a parallel shifting of the characteristic line (actuating force/current) which means that equal conditions required for a replacement can be only accurately obtained in a single point (adjusting point) of the characteristic line, but not for the entire line since the latter is always different for a plurality of solenoids.

Furthermore, the adjustment obtained in assembling varies in the course of time since the spring shows a setting behavior. In particular with high requirements of accuracy the spring must be adjusted from time to time. Further the adjustment meets difficulties since it has to be performed with the unit assembled where no adjusting values may be read during adjustment.

Summarizing, there is the following relation between the force $F_M$ produced by the solenoid, the actuating force $F_S$ of the solenoid plunger after alignment, the spring rate C, the spring bias $F_V$=X.C $$F_S=F_M-C(x\pm\Delta x)$$

for a spring which acts against the magnetic force and $$F_S=E_M+C(x\pm\Delta x)$$

for a spring acting in the direction of the magnetic force.

An important object of the present invention is to provide an improved alignment means which is less costly to manufacture and which simplifies the alignment operation.

According to the invention the alignment means comprises an electrical resistance circuit which is connected in parallel to the solenoid coil.

According to the invention the characteristic lines of different solenoids as expressed in actuating force F/current J may be made equal since the slope of the characteristic may be varied by selecting the current $J_2$ in the resistance circuit. In particular, under all operating conditions of solenoid a ratio $c=J_1/J_2$=constant may be maintained after this ratio has been determined in an adjusting means. Corresponding to the equations shown above which are true for the adjustment with a spring the alignment using a resistance circuit is expressed by the following relation between the current $J_1$ flowing in the solenoid coil and the current $J_2$ flowing in the resistance circuit:

$$F_S\sim J_{tot}=cJ_1+(l-c)J_2,$$

wherein $J_{tot}=J_1+J_2$=constant and $F_S\sim J_{tot}$, $F_M\sim J_1$ and $\Delta F_M\sim J_2$.

This results in considerable advantages since no spring to be set must be used anymore leading to considerably reduced expenditures. The value of the resistor is either determined by a force measuring device or, respectively, the resistance circuit is directly adjusted. This electrical alignment is much easier since determining the electrical values has many advantages over a mechanical adjustment. Further the electrical values may be read during the adjustment. Finally there is no variation of the spring bias anymore occuring in the course of time. Moreover the mechanical loads acting on the solenoid elements and thus wear are reduced. The proportional solenoids may be easily replaced since repeated adjustments are unnecessary. Finally the drifting motions of the armature due to varying temperature are substantially smaller.

Figure 2:
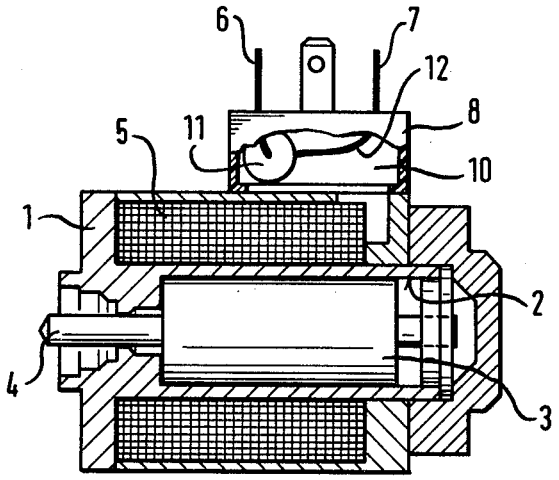
Figure 3:
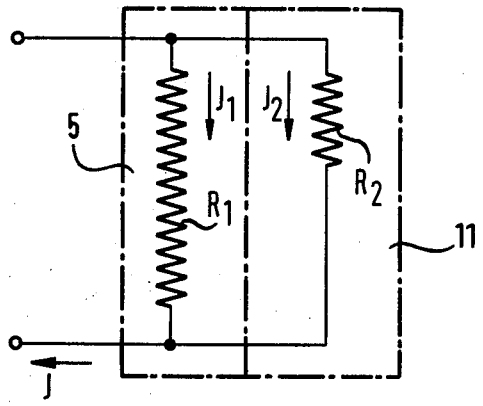
Figure 4:
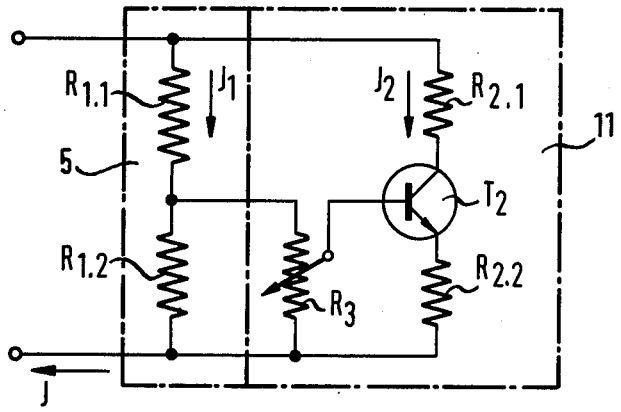

In the several figures of the drawings, like reference numerals identify like components, and in those drawings:

FIG. 1 is a section through a solenoid where the resistance circuit is located in the casing, FIG. 2 is a section through a solenoid where the resistance circuit is located in the terminal, FIG. 3 is a circuitry showing the solenoid coil and a parallel resistor, FIG. 4 is a circuitry showing the solenoid coil and a transistor circuit.

FIG. 1 shows a casing 1 having a bore 2, slidably receiving a solenoid plunger 3 which acts through an extension 4 onto a valve body (not shown) of a pressure valve or a directional control valve (not shown). An electrical coil 5 is arranged in an annular space of the casing 1. The ends of the coil 5 are connected to terminal 6 and 7 which are mounted in a plastic body 8 which is secured to the casing 1. The rear side of the casing is closed by a cover 9.

A free space 10 is provided in the casing to accommodate a resistance circuit 11 which is connected in parallel to the terminal 6 and 7 through lines 12.

The actuating force which is applied to the extension 4 by the solenoid is proportional to the value of the electrical input signal fed to the coil 5. This actuating force is finally adjusted by selecting a proper resistor of the resistance circuit 11.

According to FIG. 2 the resistance circuit 11 is not located in the casing 1, but in a somewhat enlargened hollow space 10 of the plastic body 8 in which the terminals 6 and 7 for the coil 5 are inserted. The resistance circuit 11 is connected in parallel to the coil as in the previous embodiment.

Attention is drawn to FIGS. 1 and 2 according to which the adjusting springs are eliminated which had to be inserted between the plunger 3 and the cover 9 according to the prior art and which bias force would be adjustable by a screw extending through the cover 9.

The function of the resistance circuit is explained in more detail by referring to FIG. 3. The total resistance of the coil 5 which is made up of the actual and the inductive resistance is shown to be $R_1$. The actuating force $F_M$ of the extension 4 of the plunger is proportional to the current $J_1$ flowing in the coil. Due to manufacturing tolerances the actuating forces are not equal as explained above, but scatter in a range of about 10%. This deviation must be compensated for by the alignment to obtain equal characteristics for the solenoids and for the valves being actuated.

The actuating force is set to the desired value $F_S$ by connecting the resistor $R_2$ in parallel through which resistor the partial current $J_2$ flows, to which the current $J_1$ flowing through the coil is added which results in the total current $J_{tot}$. In the embodiment of FIG. 3 the resistance circuitry consists of a single resistor $R_2$.

The total current $J_{tot}$ is controlled in an amplifier (not shown) to compensate for temperature variations in a known manner since the working temperature of the solenoid would vary the actuating force due to the fact that the total current normally differs in response to the resistance of the coil which is smaller in case of lower temperatures.

Controlling the total current $J_{tot}=J_1+J_2$, an adjustment of the partial current $J_2$ by selecting the resistance $R_2$ varies the partial current $J_1$ through the coil and thus the actuating force of the solenoid. By properly selecting the value of the resistance $R_2$ which is determined by a force measuring device the actuating force of the solenoid is adjusted.

For conventional solenoids the aligning resistance will have a value between 100 and 2000 ohm and a capacity between 2 to 3 watts. Thus a conventional film resistor may be used which is easily accommodated in the casing as shown.

FIG. 4 shows a second embodiment according to which the resistance circuit 11 comprises a transistor $T_2$ which base voltage is controlled by a potentiometer $R_3$ acting as a voltage divider, whereas a resistor $R_{2.1}$ and $R_{2.2}$ each is provided in the collector and emitter path.

The potentiometer $R_3$ is fed with a voltage proportional to the voltage drop $R_1 . J_1$ occuring accross the coil 5. This may be a measuring resistor which is connected in series to the coil $R_1$.

According to FIG. 4, however, the coil 5 is tapped and the potentiometer $R_3$ is connected to the tap thus being fed with the voltage drop accross the resistance 1.2 of the coil. This circuitry has the advantage that the internal resistance only is effective to adjust the current $J_1$ but not the measuring resistor which again has a voltage drop which would necessarily increase the voltage to be applied.

The potentiometer $R_3$ is selected so that the current $J_2$ in the parallel branch does not exceed 10% of the total current $J_{tot}$. The advantage of this circuitry over the parallel resistor lies in the adjustment which is possible by trimming the potentiometer $R_3$ thus eliminating selecting single resistors. Assembling this circuitry in the casing of the solenoid meets no problems.

I claim:

1. A solenoid for valves, comprising an electrical coil and an armature of which the actuating force is proportional to the electrical input signal being supplied to the coil, and further comprising an alignment means to finely adjusting the actuating force of said armature, characterized in that the alignment means comprises an electrical resistance circuit which is connected in parallel to said coil.

2. The coil of claim 1 characterized in that the resistance circuit consists of a single resistor.

3. The solenoid of claim 1 characterized in that the resistance circuit comprises a transistor being connected in series with at least a resistor, which transistor is controlled by a potentiometer to which a voltage is supplied which is proportional to the voltage drop occuring in the current path of the solenoid coil.

4. The solenoid of claim 3 characterized in that the potentiometer is connected to a tap of the solenoid coil.

5. The solenoid of claim 1 characterized in that the resistance circuit is mounted in the casing of the solenoid.

6. The solenoid of claim 1 characterized in that the resistance circuit is mounted in a plastic socket receiving the electrical terminals of the solenoid coil.

7. The solenoid according to claim 1 characterized in that the resistance circuit is mounted on an electrical board.

* * * * *